US007165415B2

(12) United States Patent
Nam et al.

(10) Patent No.: US 7,165,415 B2
(45) Date of Patent: Jan. 23, 2007

(54) REFRIGERATOR

(75) Inventors: Jeong-man Nam, Suwon-si (KR); Byoung-mok Kim, Taebaek-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 166 days.

(21) Appl. No.: 10/926,954

(22) Filed: Aug. 27, 2004

(65) Prior Publication Data

US 2005/0150245 A1 Jul. 14, 2005

(30) Foreign Application Priority Data

Jan. 9, 2004 (KR) ..... 10-2004-0001446

(51) Int. Cl.
*F25D 25/00* (2006.01)

(52) U.S. Cl. ..... 62/378; 62/381; 62/382

(58) Field of Classification Search ..... 62/378, 62/381, 382; 198/624, 625, 803.16; 254/98, 254/126

See application file for complete search history.

(56) References Cited

U.S. PATENT DOCUMENTS 3,614,065 A * 10/1971 Adamski et al. ..... 254/122
3,934,758 A * 1/1976 Kipp ..... 222/108
4,493,478 A * 1/1985 Fortgens ..... 254/126
4,509,724 A * 4/1985 Okada ..... 254/126
4,653,727 A * 3/1987 Chang et al. ..... 254/1
4,802,653 A * 2/1989 Engel ..... 254/126
5,165,256 A * 11/1992 Yamada ..... 62/373
5,176,362 A * 1/1993 Seksaria et al. ..... 254/126
5,603,486 A * 2/1997 Liu ..... 254/8 B
5,969,501 A * 10/1999 Glidden et al. ..... 320/101
6,308,522 B1 * 10/2001 Jones et al. ..... 62/114
6,314,751 B1 * 11/2001 Gjersvik ..... 62/457.4
6,968,974 B2 * 11/2005 Chirnomas ..... 221/9

FOREIGN PATENT DOCUMENTS

GB 2304683 A * 3/1997

(Continued)

OTHER PUBLICATIONS

Office Action dated Dec. 8, 2005 in corresponding Korean Patent Application No. 10-2004-0001446.

The First Office Action issued by the State Intellectual Property Office of People's Republic of China on Jul. 21, 2006 in the corresponding Chinese Application No. 2004100713840.4 (10 pages).

*Primary Examiner*—Mohammad M. Ali
(74) *Attorney, Agent, or Firm*—Staas & Halsey LLP

(57) ABSTRACT

The present invention relates to a refrigerator comprising: a main body having a storage compartment to store a container; a lift provided on a lower part of the storage compartment; a rotator of a pipe shape and having a pair of threaded parts with opposite threads facing to each other along a longitudinal direction; a driver to rotate the rotator; and a pair of rotation links that has a first end formed with a female screw engaged with each of the threaded parts, approaches to or separates from each other according to a rotation of the rotator, and comprises hinge connectors hingedly connected to the lifting part to be separately rotated. Thus, the present invention provides the refrigerator in which the container may be lifted as the necessary of the user with ease.

3 Claims, 9 Drawing Sheets

FOREIGN PATENT DOCUMENTS

| | | |
|---|---|---|
| JP | 04-359781 | 12/1992 |
| KR | 1995-0011049 | 9/1995 |
| KR | 10-0471050 | 11/2003 |
| KR | 2003-0085363 | 11/2003 |

* cited by examiner

REFRIGERATOR

CROSS-REFERENCE TO RELATED APPLICATIONS

This application claims the benefit of Korean Patent Application No. 2004-001446, filed on Jan. 9, 2004, in the Korean Intellectual Property Office, the disclosure of which is incorporated herein by reference.

BACKGROUND OF THE INVENTION

1. Field of the Invention

This application claims the benefit of Korean Patent Application No. 2004-001446, filed on Jan. 9, 2004, in the Korean Intellectual Property Office, the disclosure of which is incorporated herein by reference.

2. Description of the Related Art

Conventionally, a refrigerator comprises a main body having a storage compartment to accommodate food and a machine compartment to keep the temperature of the storage compartment and a door connected to a part of the main body to open/close the door opening.

As shown in FIG. 1, a conventional refrigerator comprises a main body 10 and a door 11 mounted on the main body 10 to open/close a door opening of the storage compartment 13 in an up-and-down direction.

As shown in FIG. 2, the main body has a storage compartment 13 provided inside the main body 10 to accommodate a container 15 and a machine compartment 17 to keep the temperature of the compartment 13.

The conventional refrigerator has become larger and the container accommodated in the storage compartment as well. Thus, a user should lift the heavy container put in a lower part of the large storage compartment.

Korean Patent First Publication No. 2001-0028446 discloses a lift for a container of a refrigerator. The lift comprises a plurality of springs supported on a supporting plate of a bottom of container to produce an elastic force. Thus, the lift is moved down when the door is closed and the lift is moved up due to the elastic force when the door is opened.

However, the conventional refrigerator having the lift activated only by the springs requires a spring with more elasticity as the container becomes heavier. Further, a user should press the spring by using only his own force when the user closes the door. Only the elastic force of the lift lifts the container up when the user opens the door, so that a lifting amount is varied according to the weight of the container. If the container is heavy, the lifting amount is small and the container may not be lifted as a necessary of the user.

SUMMARY OF THE INVENTION

Additional aspects and/or advantages of the invention will be set forth in part in the description which follows and, in part, will be obvious from the description, or may be learned by practice of the invention.

Accordingly, it is an aspect of the present invention to provide a refrigerator that a user lift a container accommodated in a storage compartment as his necessary with ease.

The foregoing and/or other aspects of the present invention are achieved by providing a refrigerator comprising: a main body having a storage compartment to store a container; a lift provided on a lower part of the storage compartment; a rotator of a pipe shape and having a pair of threaded parts with opposite threads facing to each other along a longitudinal direction; a driver to rotate the rotator; and a pair of rotation links that has a first end formed with a female screw engaged with each of the threaded parts, approaches to or separates from each other according to a rotation of the rotator, and comprises hinge connectors hingedly connected to the lifting part to be separately rotated.

According to an aspect of the invention, the rotation link comprises: a slider having the female screw; and a link member hingedly connected to the slider.

According to an aspect of the invention, the slider comprises a slider main body having the female screw and a guided part extending from the slider main body.

According to an aspect of the invention, the refrigerator further comprises a lower supporter to support the rotator, wherein the lower supporter is formed with a guide rail to guide the guided part.

According to an aspect of the invention, the refrigerator further comprises a container supporter connected to the lift to support the container.

According to an aspect of the invention, the driver comprises a motor, and the motor is connected to the rotator through a helical gear.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
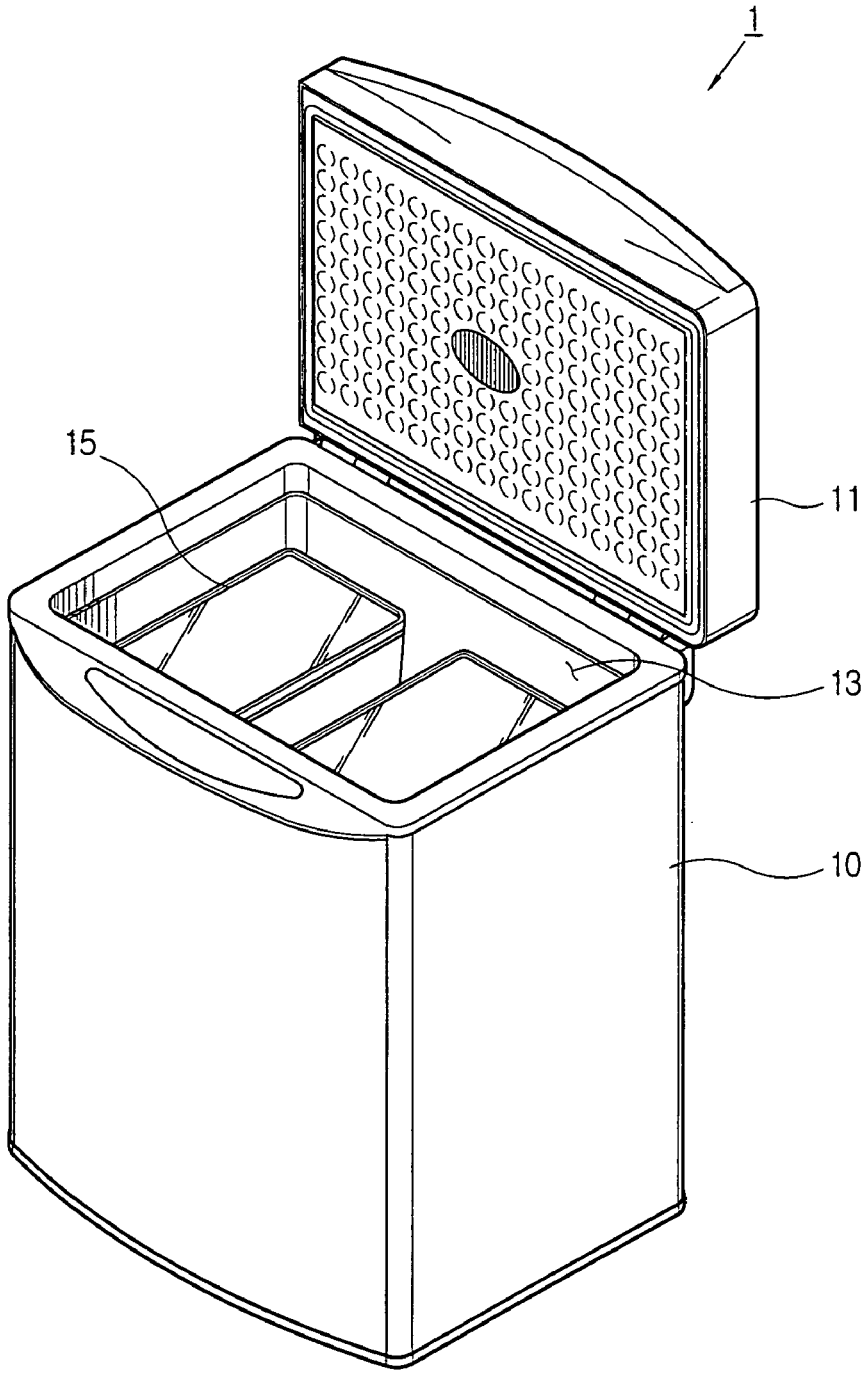
FIG. 1 (PRIOR ART)
FIG. 1 is a perspective view of a conventional refrigerator.
Figure 2:
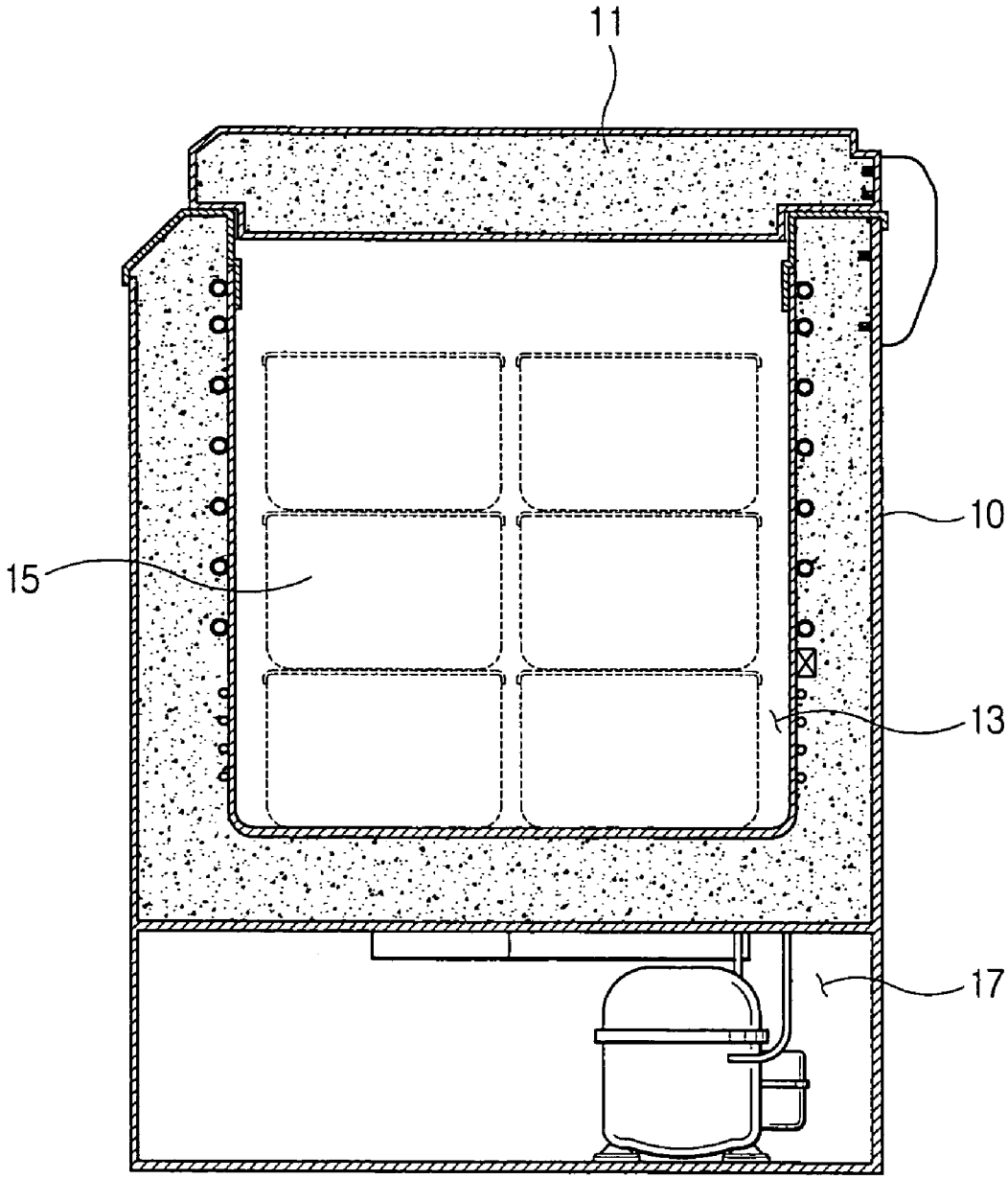
FIG. 2 (PRIOR ART)
FIG. 2 is a sectional view of FIG. 1.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 3:
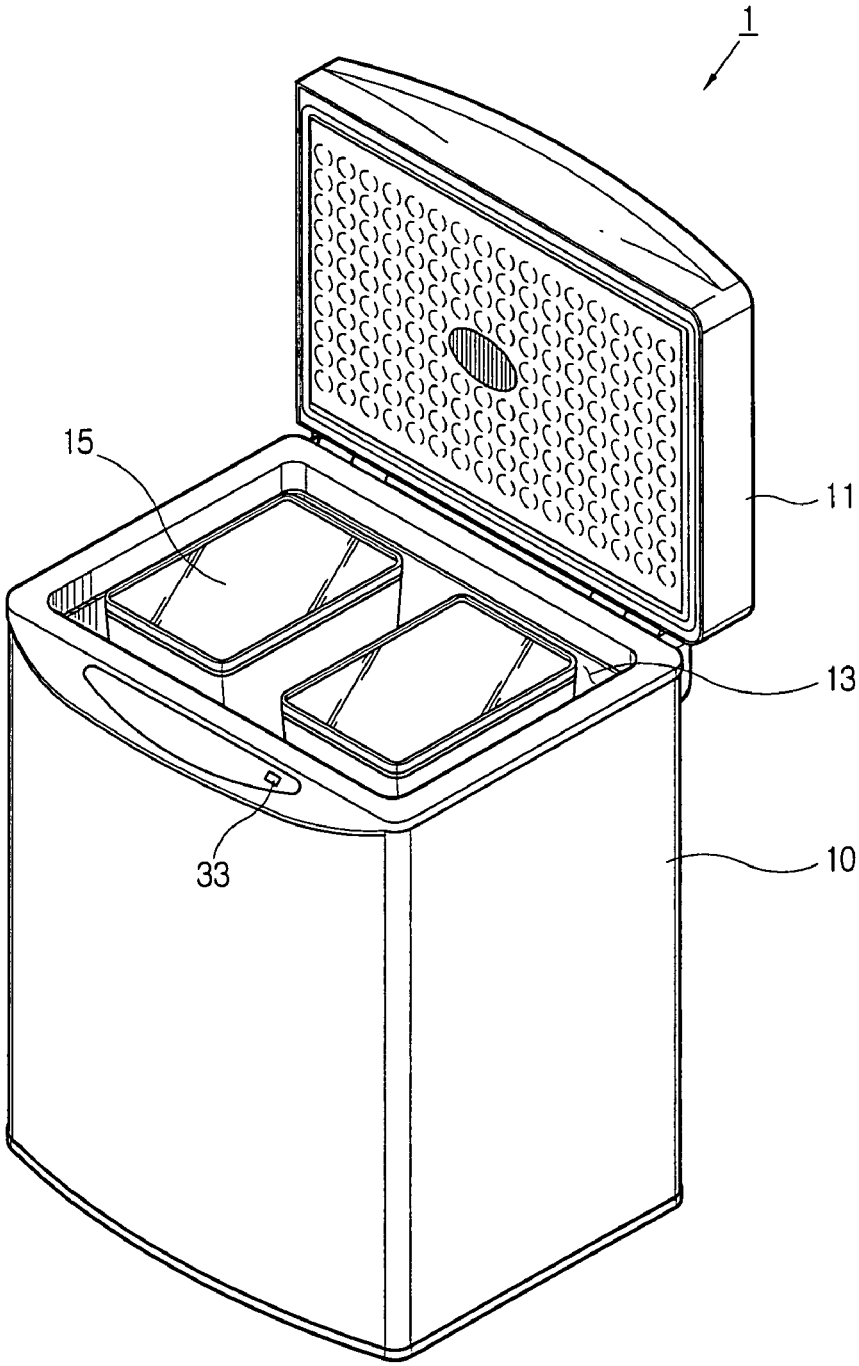
FIG. 3 is a perspective view of a refrigerator according to an embodiment of the present invention.
Figure 4:
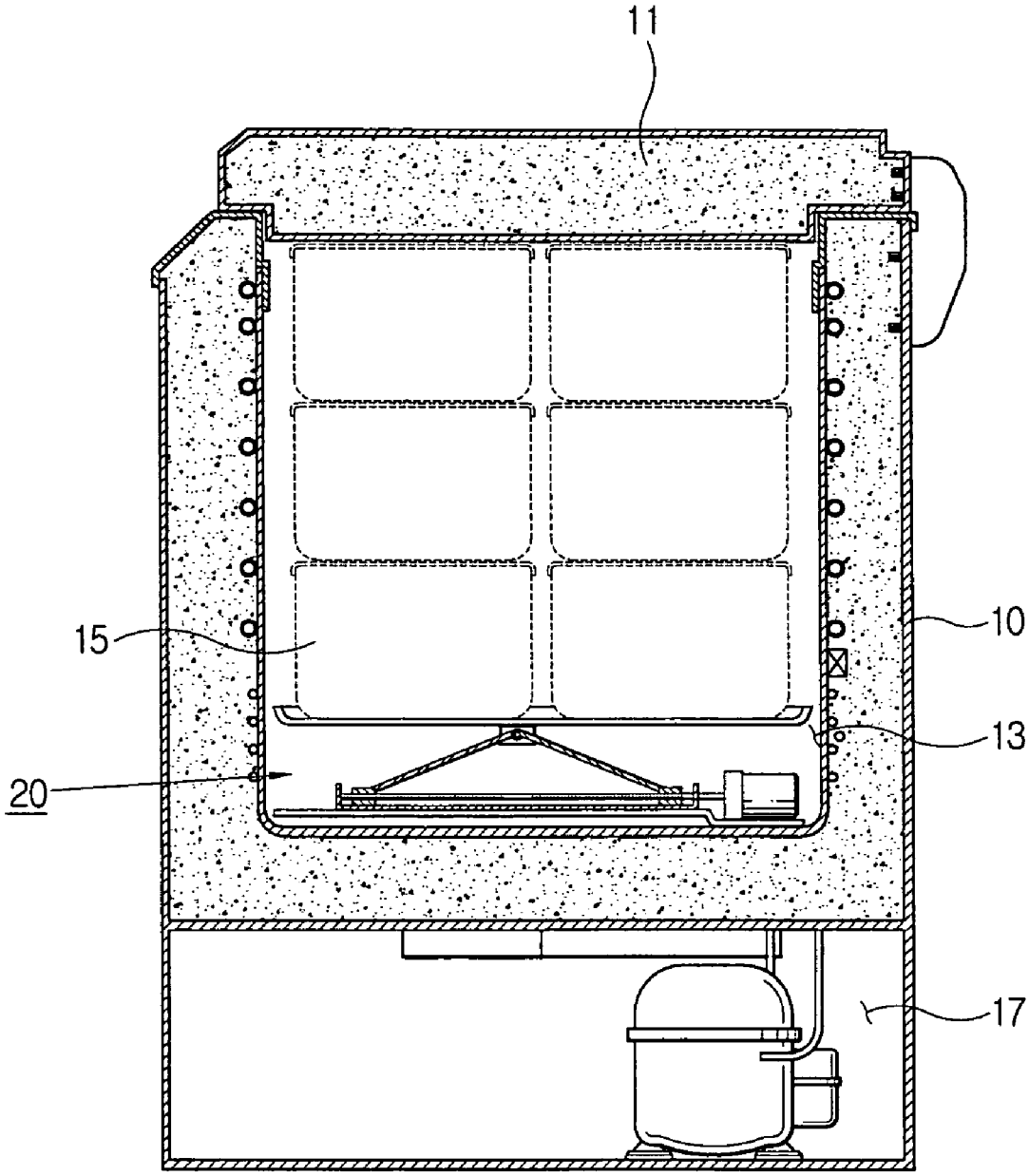
FIG. 4 is a sectional view of FIG. 3.

As shown in FIGS. 3 and 4, a refrigerator 1 according to an embodiment of the present invention comprises a main body 10 and a door 11 mounted on the main body 10 to open/close an opening of a storage compartment 13 in an up-and-down direction. The main body 10 has the storage compartment 13 provided inside the main body 10 to accommodate a container 15 and a machine compartment 17 provided under the storage compartment 13 to keep the temperature of the storage compartment 13. A lift 20 to move the storage compartment 15 in an up-and-down direction is provided inside the storage compartment 13.

Figure 5:
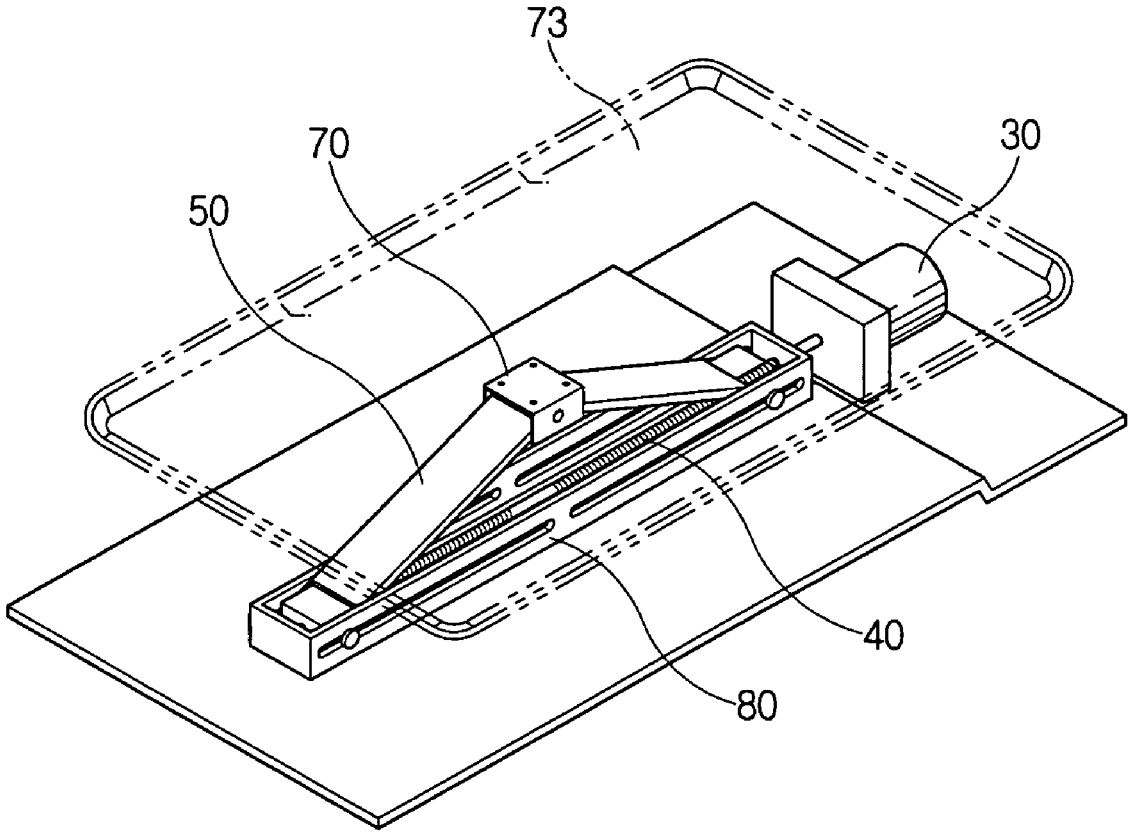
FIG. 5 is a perspective view of a lift according to an embodiment of the present invention.
Figure 6:
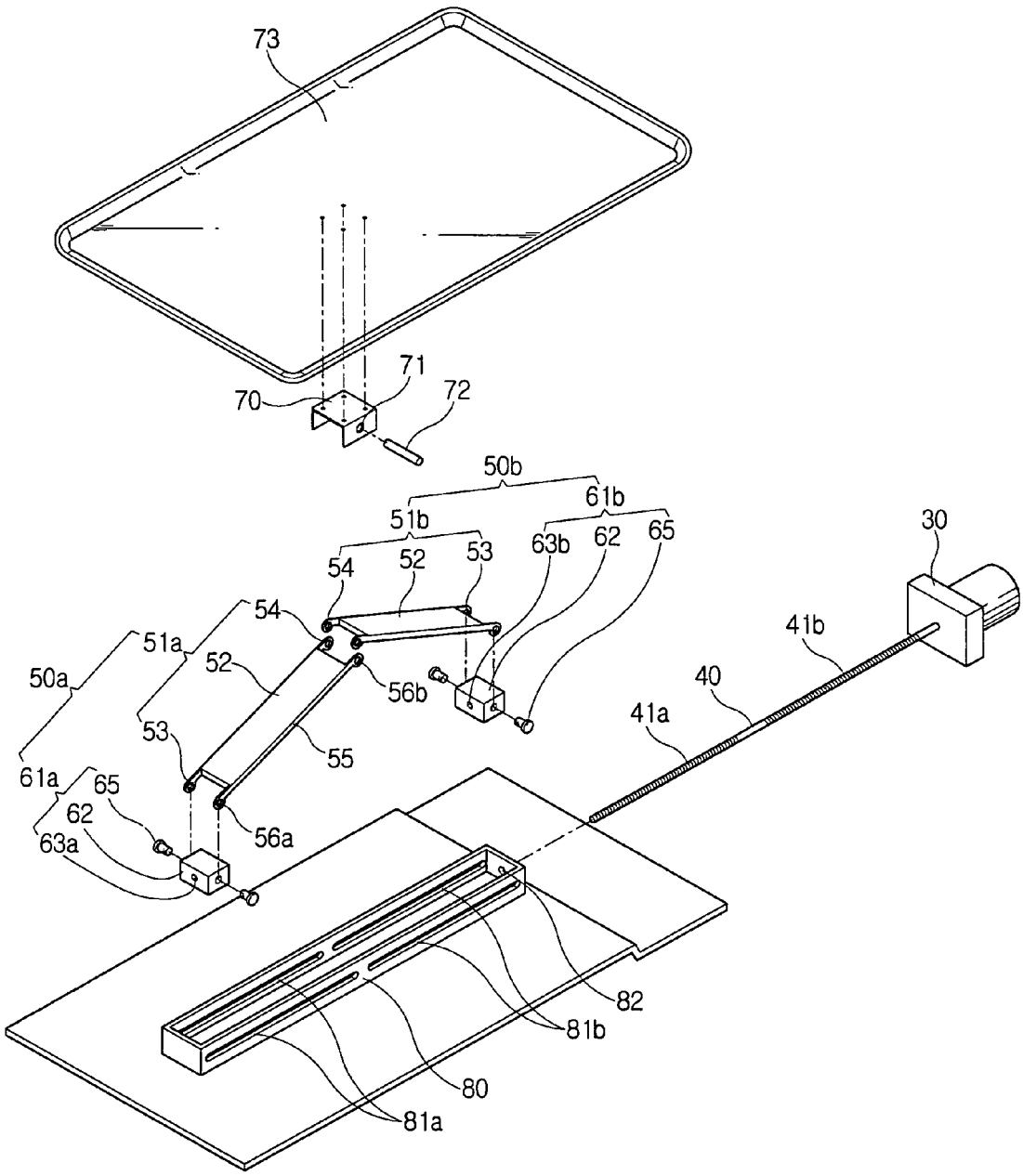
FIG. 6 is an exploded perspective view of FIG. 5.
Figure 7:
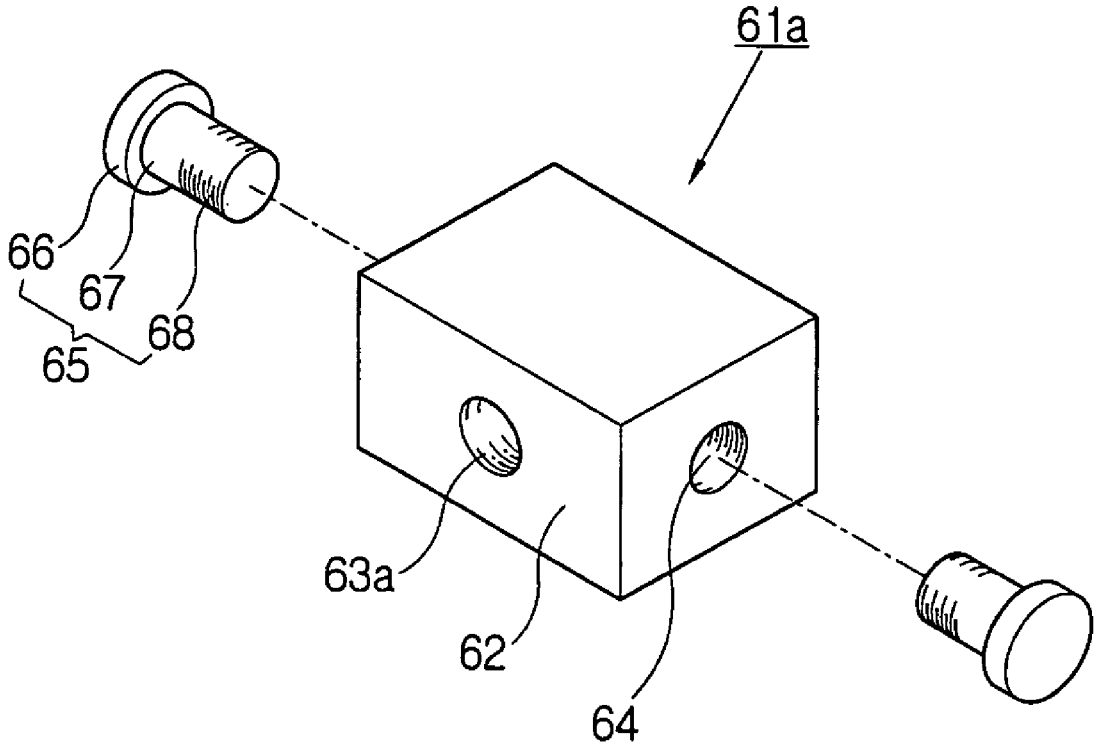
FIG. 7 is a perspective view of a slider according to an embodiment of the present invention.

As shown in FIGS. 5 through 7, the lift 20 of the refrigerator 1 according to the embodiment of the present invention comprises a container supporter 73 to support the container 15 accommodated in the storage compartment 13, a lifting part 70 provided under the container supporter 73 to support the container supporter 73 and a lower supporter 80 provided under the lifting part 70. The lift 20 further comprises a driving motor 30 provided at a side of the lower supporter 80 to produce a rotating motion, a rotator 40 having a first end connected to the driving motor 30 to be rotated and a rotation link 50 screw-connected to the rotator 40 to convert a rotating motion of the rotator 40 into a vertical motion of the container 15. Here, the "screw-connected" means that a threaded part of the rotator 40 is engaged with a female screw 63 of the rotation link 50.

The rotation link 50 moves up or down according to a rotating direction of the rotator 40 and comprises a slider 61 screw-connected to the rotator 40 and a link member 51 hingedly connected to the slider 61.

The link member 51 is of a long plate shape having curved parts 55 in a longitudinal direction. The link member 51 comprises only the curved part 55 at opposite sides in the longitudinal direction. The link member 51 further comprises a pair of first hinge connectors 53 provided at an end of the link member 51 to be hingedly connected to the slider 61. The first hinge connectors 53 are formed with a pair of first connecting holes 56*a* on the curved parts 55, which faces to each other across the rotator 40. Each of the first hinge connector 53 is not limited to the embodiment described above, and a shape of each of the first hinge connectors 53 may be varied. For example, an end of the curved part of the first hinge connector 53 may be of ' ' shape. As described above, an end at which the first hinge connector 53 is provided comprises only the curved part 55, which prevents interference between the link member 51 and the slider main body 62 when the rotation link 50 moves down. A pair of second hinge connectors 54 to be hingedly connected to the lift 70 is formed at the other end of the link member 51. Also, the second hinge connector 54 is formed on the curved part 55 extending from an end of the rotation link 50. An end at which each of the second hinge connectors 54 are provided comprises only the curved part 55, which prevents an interference between the pair of link members 51 at an area where the second connectors 54 are connected to the lifting part 70 when the rotation link 50 moves down. The first hinge connector 53 and the second hinge connector 54 are linked by a linking part 52.

The link member 51 comprises a first link member 51*a* and a second link member 52*b* each hingedly connected to the lifting part 70 by a connecting pin 72. The lifting part 70 hingedly connected to the link member 51 is formed with a connecting hole 71; The connecting pin 72 passes the connecting hole 71 and the second hinge connector 54 to hingedly connect the link member 51 and the lifting part 70. As an aspect of the present invention, the distance between the pair of connecting holes 56*b* of the second hinge connector 54 on the first link member 51*a* may be somewhat different from the distance between the pair of connecting holes 56*b* of the second hinge connector 54 on the second link member 51*b*, for a convenience of a hinge-connection. In the embodiment described above, each of the link members 51 are firstly connected to each other and then the pair of link members 51 is hingedly connected to the lifting part 70 as a single body, but not limited thereto. Each of the link members 51 may be separately connected to the lifting part 70.

An end of the link member 51 is hingedly connected to the slider 60 to be lifted corresponding to a rotation of the rotating member 40 and the other end of the link member 51 hingedly connected to the lifting part 70 to raise the container supporter 73 provided on the lifting part 70. When the lifting part moves down, a rotation direction of the rotator 40 is reversed and a process reverse to raising the container supporter 73 is accomplished.

The slider main body 62 of the slider 61 is formed with a female screw 63 to accommodate the rotator 40. The female screw 63 is shaped corresponding to a threaded part 41 of the rotator 40 and passable through the slider main body 62. The female screw 63 and the threaded part 41 of the rotator 40 are screw-connected to each other, so that the slider 61 slides in a longitudinal direction of the rotator 40 corresponding to a rotation of the rotator 40.

The slider 61 comprises the slider main body 62 of an approximately hexahedron shape and a pair of pins 65 each screw-connected to each of opposite surfaces of the slider main body 62, which face to each other. The pin 65 is hingedly connected to the first hinge connector 53 of the link member 51 and allows the rotation link 50 to move with stability.

The pin 65 comprises a head 66, a linking part 67 and a pin thread 68. The pin thread 68 is screw-connected to a slider thread 64 formed in the slider main body 62 to securely connect to the pin in the slider main body 62. The head 66 protrudes out of a guide rail 81 of the lower supporter 80 to reciprocate on the guide rail 81 corresponding to a motion of the slider 61. The head 66 is sized that the head 66 doesn't get out of the guide rail 81. Thus, the slider 61 and the rotation link 50 connected to the slider 61 can be stably moved without being shaken in a right-and-left direction.

Between the head 66 and the pin thread 68 is provided the linking part 67 having a bar shape and hingedly connected to the first hinge connector 53 of the link member 51. A first part of the linking part 67 is connected to the first hinge connector 53 of the link member 51 and a second part of the linking part 67 is in rolling-contact with a lower part of the guide rail 81 to guide the slider 61. That is, the guide rail 81 provided on the lower supporter 80 guides the linking part 67 and the head 66, which allows the lower supporter 80 to support the rotator 40 and prevents the rotator 40 from moving in a traverse direction of the lower supporter 80. The slider 60 comprises a first slider 61*a* and a second slider 61*b* hingedly connected to the first link member 51*a* and the second link member 51*b*, respectively.

The slider 61 may be variously embodied. That is, an upper surface of the slider 61 may be hingedly connected to the link member 51. Then, not only a shape of the slider 61 but also a shape of the first hinge connector 53 of the link member 51 may be changed. Further, the pin 65 may not comprise the head 66. Shapes of the slider main body 62 and the linking part 67 may not be limited to the shapes of the slider main body 62 and the linking part 67 in the embodiment of the present invention, but may be varied.

The rotator 40 is of a cylinder shape and is formed with a first threaded part 41*a* threaded in a predetermined direction on a first half of the rotator 40 and a second threaded part 41*b* threaded in a reverse direction on a second half of the rotator 40. A first end of the rotator 40 is connected to the driving motor 30. In the embodiment, the first end of the rotator 40 is directly connected to the driving motor 30, but not limited thereto. That is, a gear may be provided between an end of the rotator 40 and the driving motor 30. As an aspect of the present invention, the gear may be a helical gear.

The driving motor 30 produces a rotation motion when electric power is supplied to the driving motor 30. A generating power shaft (not shown) connected to the rotator 40 to transmit a rotation force is provided at a first end of the driving motor 30 and a switch 33 connected to the driving motor 30 to rotate the driving motor 30 in clockwise and counterclockwise directions at a part of the main body 10 (refer to FIG. 3).

The lower supporter 80 accommodates the rotator 40 to allow the rotation link 50 to move with stablity. The lower supporter 80 is of an approximately cuboid shape having no upper surface. The guide rail 81 is provided on opposite sides of the lower supporter 80 with the exception of a part of the opposite sides of the lower supporter 80. The guide rail 81 is divided into two parts 81*a* and 81*b* according a threaded direction of the threaded part 41, but not limited thereto. The two parts 81*a* and 81*b* of the guide rail 81 may be connected without a division. A part of the linking part 67 of the slider 61 is hung on the guide rail 81 and the head 66 linked to the linking part 67 protrudes out of the lower supporter 80 across the guide rail 81. The width of the slider 61 may be wider than the distance between opposite sides of the guide rail 81. A rotator through hole 80 is formed on a first end of the lower supporter 80 to pass the rotator 40 connected to the driving motor 30. A rotator-supporting hole (not shown) is formed on a second end of the lower supporter 80 to support the rotator 40.

The guide rail 81 may be varied as long as the guide rail 81 can guide the linking part 67 and the head 66 in a longitudinal direction. Further, the guide rail 81 may be provided separately from the lower supporter 80.

According to the embodiment of the present invention, a description of an assembly of the lift 20 follows. Each of the female screw 63 of the pair of slider main body 62 and the threaded part 41 of the rotator 40 is screw-connected to connect the slider main body 61 with the rotator 40. The threaded part 41 comprises two parts 41*a* and 41*b* each threaded in direction opposite to each other, so that each of the pair of slider main bodies 62 is inserted in the opposite ends of the rotator 40. Here, the pair of slider main bodies 62 may be positioned in the same distance from a point where the threaded part 41 begins to be threaded in an opposite direction.

The rotator 40 on which the pair of slider main bodies 62 is mounted is securely mounted on the lower supporter 80 by passing the rotator through hole 82 of the lower supporter 80 and the rotator-supporting hole. Then, each of the connecting holes 56*a* of pair of the first hinge connectors 53 is aligned with the slider thread 64. Thereafter, the linking part 67 is inserted in the first hinge connector 53 and the pin screw 66 is inserted in the slider thread 64. The pin 65 is connected to the slider main body 62 across the guide rail 81 provided on the lower supporter 80. Then, the link member 51 is hingedly connected to the slider 61 and the head 66 protrudes outside of the lower supporter 80 across the guide rail 81.

Then, the connecting pin 72 is inserted in the second hinge connector 54 and the connecting hole 71, which hingedly connects the link member 51 to the lifting part 70. The driving motor 30 is connected to the rotator 40 and the container supporter 73 is mounted on the lifting part 70, which completes the assembly of the lift 20 according to the embodiment of the present invention.

Figure 8:
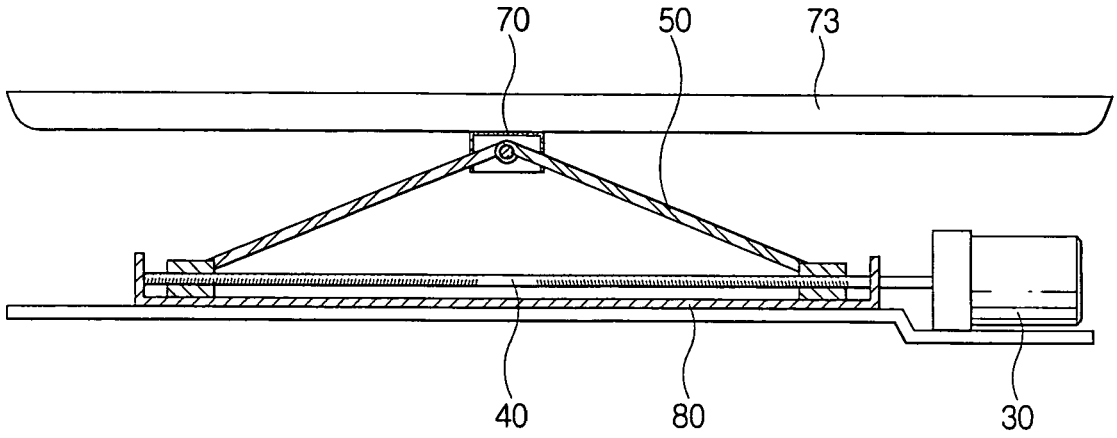
FIG. 8 is a sectional view showing that the lift according to the embodiment of the present invention is lifted down.

FIG. 8 shows the lift 20 moving down when the link member 51 of the lift 20 is folded of the rotator 40.

Figure 9:
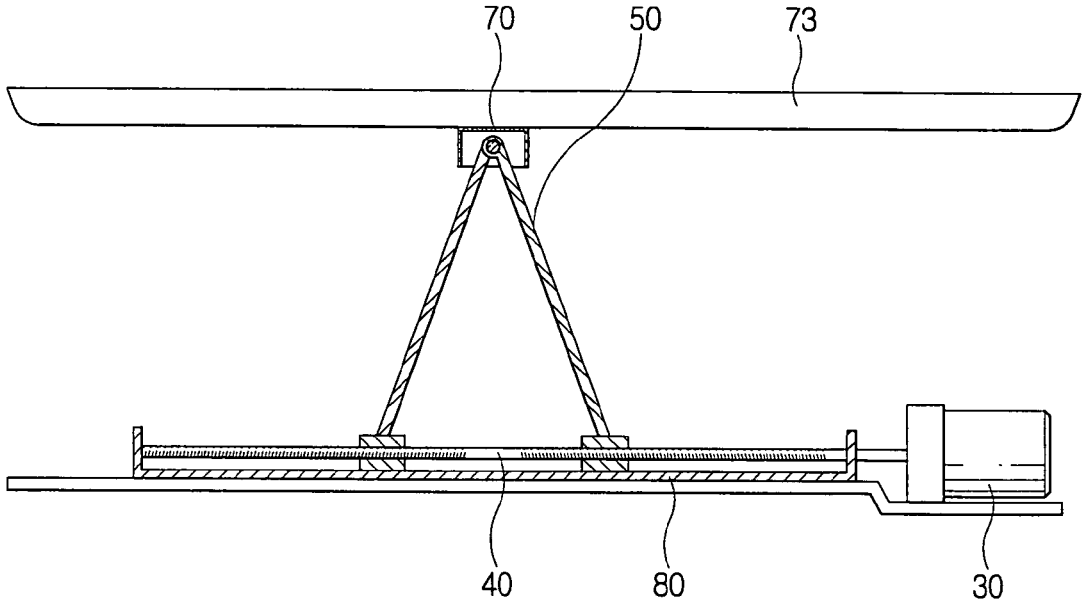
FIG. 9 is a sectional view showing that the lift according to the embodiment of the present invention is lifted up.

FIG. 9 shows the lift 20 raising the container 15 when the link member 51 is vertical to the rotator 40.

A description of a process to raise the lift 20 of the refrigerator 1 according to the embodiment of the present invention follows. If a user activates the switch 33 provided at a part of the main body 10 and connected to the driving motor 30 of the lift 20, the power-generating shaft or the driving motor 30 rotates to amount of angle corresponding to the operation by the switch 33. At the same time, the rotator 40 connected to the driving motor 30 rotates. Then, the pair of sliders 61 screw-connected to rotator 40 moves toward a center of the rotator 40, which moves a part of each of the pair of link members 51 hingedly connected to slider 61 toward a center of the rotator 40. That is, the pair of link members 51 faces to each other. As the first end of the link member 51 moves toward the center, the second end of the link member 51 hingedly connected to the lifting part 70 rises, which raises the linking part 70 as well. Thus, the container supporter 73 and the container 15 on the lifting part 70 are lifted. Thus, a user may easily pull the container 15 out of the refrigerator without bending his waist downwardly. At this time, a part of the linking part 67 of the slider 61 moves toward the center of the rotator 40 along the guide rail 81 and the head 66 connected to the linking part 67 moves toward the center of the rotator 67, too. The linking part 67 and the head 66 prevent the rotation link 50 from being shaken in a right-and-left direction and support the rotator screw-connected to the slider main body 62.

A description of a process to move the lift 20 down follows. At first, the switch 33 of the main body 10 is activated to rotate the driving motor 30 in a direction reverse to the direction to move the lift 20 up. Then, the container 15 is lifted down according to a process reverse to the process described above. That is, the pair of rotation links 50 separates from each other. Thus, the user can put the container 15 in the storage compartment 13 without bending his waist.

All of components of the lift 20 may be accommodated in the lower supporter 80 with the exception of the driving motor 30, which may reduce a space for the lift 20. The lift 20 according to the present invention has the small height, thereby minimizing a space for the lift 20 in the storage compartment.

The lift 20 may be accommodated in the storage compartment 13 of the refrigerator 1 and a cable to connect the driving motor 30 and the switch 33 may be detachable. Further, the lift 20 may be integrally provided with the main body 10 of the refrigerator 1.

As described above, the present invention provides the refrigerator in which the container may be lifted as the necessary of the user with ease.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body having a storage compartment to store a container;

a lift provided on a lower part of the storage compartment;

a rotator of a pipe shape and having a pair of threaded parts with opposite threads facing to each other along a longitudinal direction;

a driver to rotate the rotator;

a pair of rotation links that has a first end formed with a female screw engaged with each of the threaded parts, approaches to or separates from each other according to a rotation of the rotator, and comprises hinge connectors hingedly connected to the lifting part to be separately rotated, a slider having the female screw and a link member hingedly connected to the slider, wherein the slider includes a slider main body having the female screw and a guided part extending from the slider main body; and a lower supporter to support the rotator, wherein the lower supporter is formed with a guide rail to guide the guided part.

2. The refrigerator according to claim 1, further comprising a container supporter connected to the lift to support the container.

3. The refrigerator according to claim 1, wherein the driver comprises a motor, and the motor is connected to the rotator through a helical gear.

* * * * *

UNITED STATES PATENT AND TRADEMARK OFFICE

CERTIFICATE OF CORRECTION

PATENT NO. : 7,165,415 B2
APPLICATION NO. : 10/926954
DATED : January 23, 2007
INVENTOR(S) : Jeong-man Nam et al.

It is certified that error appears in the above-identified patent and that said Letters Patent is hereby corrected as shown below:

On Title page item 56

First Page, Column 2 (Other Publications), Line 5, change "2004100713840.4" to --2004/10071380.4--.

Signed and Sealed this

Seventeenth Day of April, 2007

JON W. DUDAS
*Director of the United States Patent and Trademark Office*